US009995080B2

(12) United States Patent
Stevens et al.

(10) Patent No.: US 9,995,080 B2
(45) **Date of Patent: *Jun. 12, 2018**

(54) DOOR JAMB FOR FLUSH IN-SWING DOOR

(71) Applicant: Studco Building Systems US, LLC, Webster, NY (US)

(72) Inventors: Gordon Stevens, Webster, NY (US); James Rowden, Webster, NY (US); Ian Rowden, Webster, NY (US)

(73) Assignee: Studco Building Sytems US, LLC, Webster, NY (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/207,922

(22) Filed: Jul. 12, 2016

(65) Prior Publication Data

US 2016/0319584 A1 Nov. 3, 2016

Related U.S. Application Data

(63) Continuation of application No. 14/498,125, filed on Sep. 26, 2014, now Pat. No. 9,416,580.

(Continued)

(51) Int. Cl.

| | |
|---|---|
| ***E06B 1/04*** | (2006.01) |
| ***E06B 1/52*** | (2006.01) |
| ***E06B 1/34*** | (2006.01) |
| ***E06B 7/28*** | (2006.01) |
| ***E04F 13/02*** | (2006.01) |
| ***E06B 1/12*** | (2006.01) |
| ***E06B 1/16*** | (2006.01) |

(Continued)

(52) U.S. Cl.

CPC ..... *E06B 1/52* (2013.01); *E04F 13/02* (2013.01); *E06B 1/12* (2013.01); *E06B 1/16* (2013.01); *E06B 1/34* (2013.01); *E06B 1/347* (2013.01); *E06B 1/6015* (2013.01); *E06B 7/28* (2013.01); *E06B 2001/624* (2013.01)

(58) Field of Classification Search

CPC . E06B 1/52; E06B 1/526; E06B 1/347; E06B 1/12; E06B 1/34; E06B 7/28; E06B 2001/624; E06B 1/14; E06B 1/16; E06B 1/6015

USPC ..... 52/204.1, 210, 211, 213, 656.4, 656.7, 52/205

See application file for complete search history.

(56) References Cited

U.S. PATENT DOCUMENTS 1,015,989 A * 1/1912 Buchholz ..... E06B 1/34 49/504
4,510,722 A * 4/1985 van Wieringen ..... E06B 1/603 49/505

(Continued)

FOREIGN PATENT DOCUMENTS

| | | |
|---|---|---|
| AT | 506226 A4 | 7/2009 |
| EP | 2453098 A1 | 5/2012 |
| WO | WO 9742390 A1 | 11/1997 |

OTHER PUBLICATIONS

Modernus. All Doors—Office Walls, Sliding Doors, Swing Doors, Pocket Doors. http://www.modernus.com/products/all-doors/grid/.

(Continued)

*Primary Examiner* — Brian D Mattei
(74) *Attorney, Agent, or Firm* — Woods Oviatt Gilman LLP; Katherine H. McGuire, Esq.

(57) ABSTRACT

A door jamb configured to provide a flush in-swing door when viewed in the direction of door in-swing.

4 Claims, 9 Drawing Sheets

Related U.S. Application Data

(60) Provisional application No. 61/882,836, filed on Sep. 26, 2013.

(51) Int. Cl.
*E06B 1/60* (2006.01)
*E06B 1/62* (2006.01)

(56) References Cited

U.S. PATENT DOCUMENTS 4,637,183 A 1/1987 Metz
4,665,666 A * 5/1987 Hampton ..... E06B 1/006 52/211
4,698,944 A 10/1987 Wilkins, Jr.
5,630,302 A * 5/1997 Rosenband ..... E04H 1/1266 52/204.1
6,282,851 B1 9/2001 Beaton
6,550,193 B2 1/2003 Potts
6,526,694 B1 3/2003 Cosgrove
7,516,581 B2 4/2009 Vidal
7,849,657 B2 12/2010 Schnepf et al.
7,987,635 B2 * 8/2011 Thielke ..... E04H 1/1266 49/382
2008/0172969 A1 * 7/2008 Schnepf ..... E06B 3/9642 52/489.1
2010/0230979 A1 * 9/2010 Gries ..... E05C 19/16 292/251.5
2013/0000203 A1 1/2013 Platt

OTHER PUBLICATIONS

International Search Report. International Application No. PCT/AU 97/00272. dated Jun. 19, 1997. Authorized Officer: M.E. Dixon.
European Search Report. Application No. 14186556.8-1601. dated Mar. 6, 2015. Search completed Feb. 27, 2015. Located "The Hague".
Studco Building Systems, LLC. EZY Jamb. 18 Gauge EZY Jamb Trimless Door Frame (for 1-¾" Doors), Spec Data.
Studco Building Systems, LLC. EZY Jamb. 18 Gauge EZY Jamb Trimless Door Frame, Oct. 10, 2014 at 3:19 p.m.

* cited by examiner

DOOR JAMB FOR FLUSH IN-SWING DOOR

This application is a continuation of U.S. patent application Ser. No. 14/498,125 filed Sep. 26, 2014 which claims the benefit of U.S. Provisional Application Ser. No. 61/882,836 filed on Sep. 26, 2013, the disclosure of which is incorporated herein by reference.

FIELD OF THE INVENTION

The present invention generally relates to a door jamb and more particularly relates to a door jamb and door jamb assembly which allows for a flush finish of the door with respect to the adjoining wall on the side of the door facing the direction of door swing when opening.

BACKGROUND OF THE INVENTION

Conventional swing-type doors are mounted via hardware such as hinges to door jambs which attach to and define the opening in the wall at the location of the door. Doors and door jambs come in a variety of different materials and configurations depending on the desired functionality and aesthetics. A so-called "in-swing" door refers to a door which swings open into a space such as a room. If one were standing in a hallway of a hotel, for example, doors which swing open into the room (as opposed to swinging into the hallway) are referred to as "in-swing" doors. For many people, conventional door jambs for in-swing doors are visually displeasing in that they include multi-angled surfaces which are visible when the door is closed and thus fail to provide the complete "clean look" which is very desirable in present day architecture.

One known prior attempt to provide a door jamb which provides a flush finish with an in-swing door is seen in FIGS. 1 and 2. In this prior art door jamb, the door jamb 10 is cut from a block of wood and is affixed to the wall 12 via nail 14. The door jamb in cross section is configured to match the contour of the leading edge of the door 16. In order to blend the wood door jamb with the wall surface 12*a* and also achieve the desired flush finish at door side 16*a* with wall side 12*a*, a smooth layer of plaster 18*a* is applied over the wall surface 12*a* and door jamb surface 10*a*. In order to enhance the bonding of the plaster layer 18*a* to the wall and jamb, the jamb 10 includes a notch 10*b* (or an angled surface 10*c* in an alternate embodiment) which forms an enlarged open area 20*a* between the wall and jamb in which the plaster 18*a* may be applied and act as a further securing point for the plaster to hold to the wall and jamb. It is thus evident that this prior art door jamb does not provide the desired lasting visual results in that the plaster is incompatible with wood and is susceptible to crazing and cracking as indicated by reference numeral 22 in FIG. 1.

Furthermore, and quite critically, the fact that the securing nail (or bolt) extends through the jamb in line with the direction of the wall (i.e., the nail extends generally parallel to the direction in which the wall extends) creates a weak attachment between the jamb 10 and wall stud. More particularly, the forces created during regular door opening and closing at the jamb impact the nail securement point (which is located at the jamb-door interface) which may cause the jamb to move relative to the wall stud and potentially cause intermittent and ultimately permanent separation of the jamb from the stud, the result of which creates unsightly jamb/wall gaps and cracking of the wall finish at this juncture. This prior art door jamb (as well as any other prior art jambs which are secured with fasteners located at the door/jamb interface) is therefore not an appropriate solution to the need for a door jamb which provides a long-lasting flush finish for an in-swing door.

SUMMARY OF THE INVENTION

The present invention solves the above drawbacks of the prior art door jamb by providing a door jamb that is easy to install and gives the desired flush finish to an in-swing door while avoiding the prior art problems with cracking plaster and destructive jamb movement during use.

In an embodiment, the inventive door jamb comprises a unitary body having opposite side walls which are spaced a distance allowing the jamb to attach to a door opening with the side walls engaging opposite surfaces of the wall defining the door opening. The side walls include a plurality of holes through which suitable fasteners may be passed to secure the jamb to the wall stud defining the door opening. The jamb includes a plurality of wall segments which contiguously extend between the opposite side walls. The wall segments are formed into a desired geometry using a roll forming process, for example. A protrusion/juncture is formed in the jamb adjacent each of the opposite side walls and is spaced outwardly therefrom providing a space in which wall finishing material such as plaster may be applied over the jamb side wall (and extending through the holes in the side walls) up to the point of the protrusion/juncture. The geometry of the jamb and corresponding complimentary geometry of the door leading latch face and door hinge face allow for the flush finish of the in-swing door front surface with the surrounding wall. More particularly, the jamb wall segments extending between the jamb side walls are sized and angled in a particular relationship with each other such that the in-swing (front) door surface will lie flush with the surrounding wall surface.

In an embodiment, the invention provides a door jamb for an in-swing door, said door jamb comprising:

- first and second, spaced side wall segments adapted to be attached to opposite sides of a wall stud at a door opening;
- third, fourth, fifth and sixth contiguous wall segments extending from said first side wall toward said second side wall, said third and fourth wall segments forming a protrusion at their juncture, said protrusion and said first side wall being offset from each other and thereby defining a space which may be filled with a wall finishing material;
- said fourth wall segment extending parallel to and spaced from said sixth wall segment such that said fourth, fifth and sixth wall segments together form a stepped surface against which a complimentary shaped door latch face surface of an in-swing door is positioned when in the closed position and wherein the door latch face front edge lies closely adjacent said protrusion to create a flush finish of the door front surface with the wall surrounding the door opening.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

DETAILED DESCRIPTION OF A PREFERRED EMBODIMENT

This document provides and describes an overview of an exemplary environment and implementation of the present invention.

Referring to FIGS. 3-6, one possible embodiment of the invention is shown to include a unitary door jamb 30 which is made from a material which is compatible with other materials (e.g., plaster) which may be applied thereon as part of the installation and finishing process. Jamb 30 is preferably although not necessarily formed of a metal such as steel or aluminum, for example. During manufacture, door jamb 30 is formed into the desired geometry and provided in linear form which may be cut to the desired length. In one embodiment, door jamb 30 is fabricated as a unitary part and formed into the desired geometry using a rolling process from a sheet of metal material.

As seen best in FIGS. 3A-C and 4, jamb 30 includes opposite first and second side walls 30*a* and 30*b* with seven defined wall segments 30*b*' 30*c*, 30*d*, 30*e*, 30*ef*, 30*f*, 30*af* extending contiguously therebetween, respectively. Side walls 30*a* and 30*b* are spaced from each other by a distance "D" which is slightly larger than the width "W" of the wall (including any dry wall such as indicated at 40*a* and 40*b*) to which it will be attached. As such, when the jamb 30 is mounted to the wall stud 12', the jamb side walls 30*a* and 30*b* engage and lie in abutting relation to the opposite sides of the wall stud (or to the sheets of any applied dry wall 40*a*, 40*b*) to which the jamb 30 attaches via suitable fasteners 50*a*, 50*b* which extend through selected ones of a plurality of jamb side wall holes 30*a*', 30*b*', respectively, and continue to extend through dry wall 40*a*,40*b* and into wall stud 12'.

Figure 1:
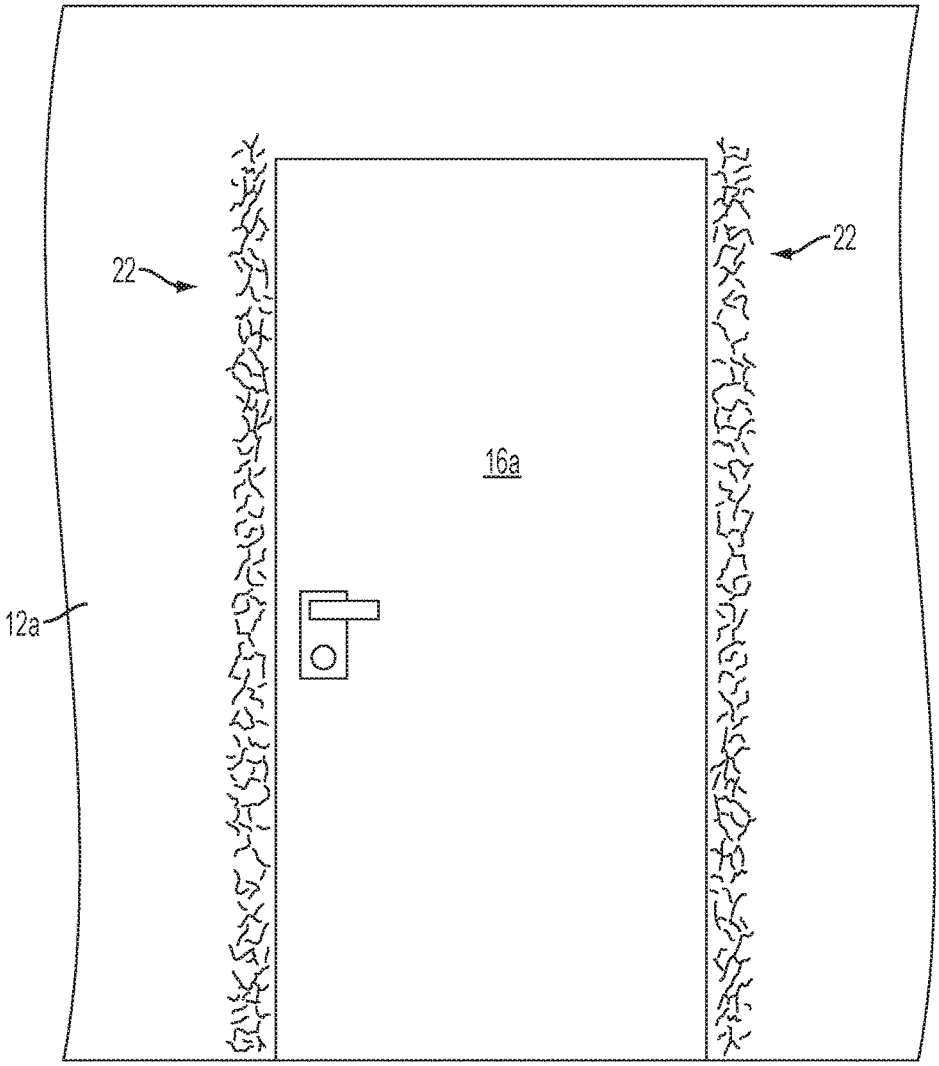
FIG. 1 PRIOR ART
FIG. 1 is prior art a front elevational view of a flush in-swing door installed using a prior art door jamb.
Figure 2:
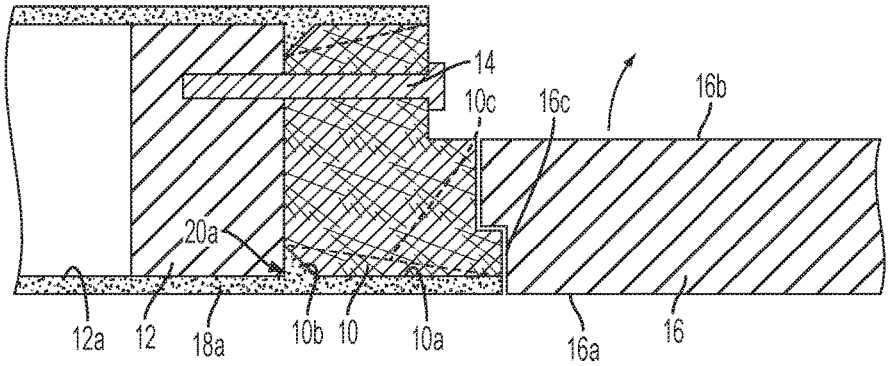
FIG. 2 PRIOR ART
FIG. 2 is prior art showing a fragmented, enlarged cross-sectional view of the wall, door jamb and door of FIG. 1.
Figure 3A:
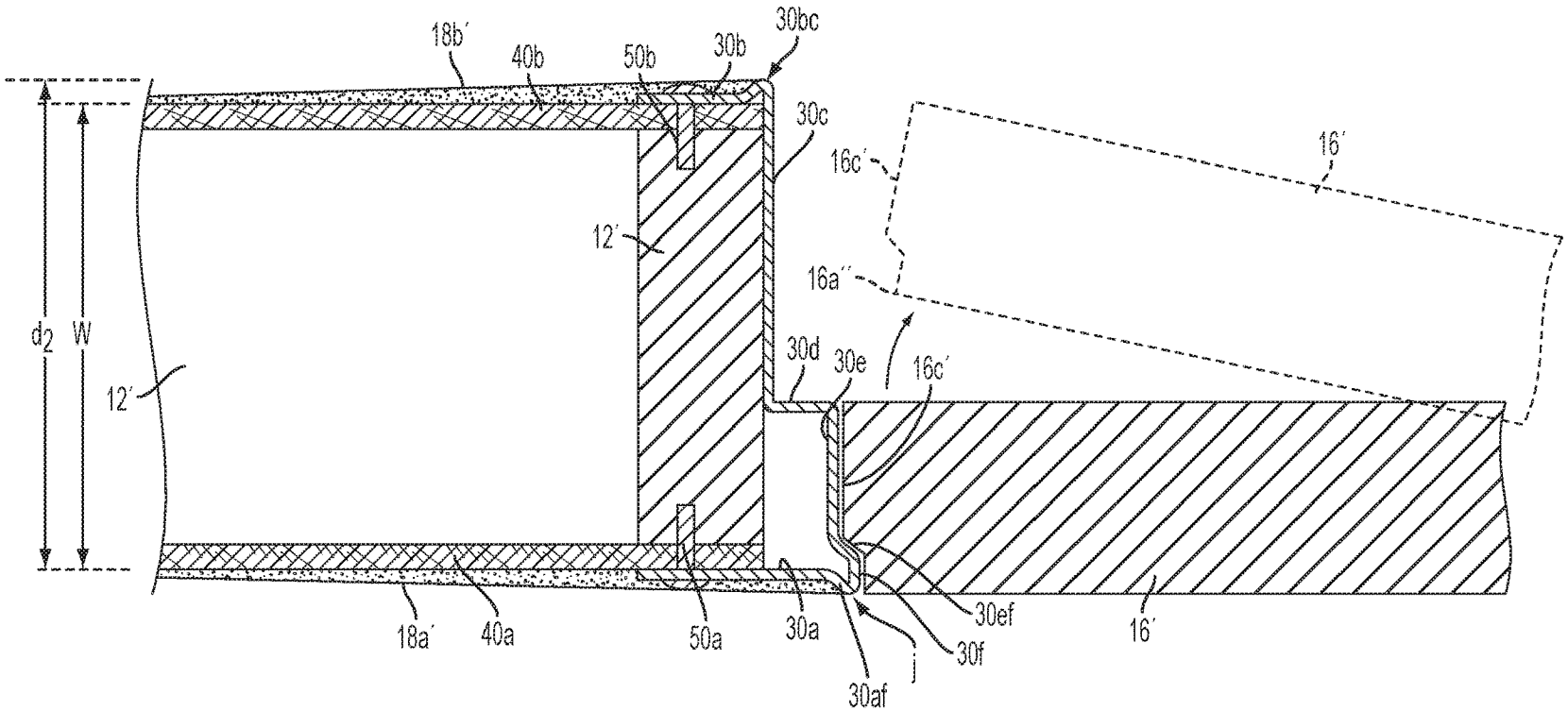
FIG. 3A is a fragmented, enlarged, cross sectional view of an embodiment of the present invention showing the wall, door jamb and door leading edge.

As seen in FIG. 3A, fasteners 50*a*, 50*b* extend toward each other (perpendicular to the plane of the door 16' when closed) from opposite ends of the wall stud 12'. The jamb 30 is thus very securely attached to the wall stud 12' and dry wall 40*a*, 40*b*. As explained in more detail below, plaster 18*a*' and 18*b*' is applied over the jamb side walls 30*a*, 30*b* and flows through the side wall openings 30*a*', 30*b*', ultimately drying and "locking" the plaster to the jamb side walls. This structure between the jamb, fasteners, stud and plaster create an incredibly strong and stable jamb structure which all together could be considered a monolithic structure in terms of mechanical stability. As such, jamb 30 can withstand forces of door movement without mechanically failing or separating from its surrounding structure as identified as a significant problem with the much less stable prior art in-swing door jambs discussed above.

Figure 6:
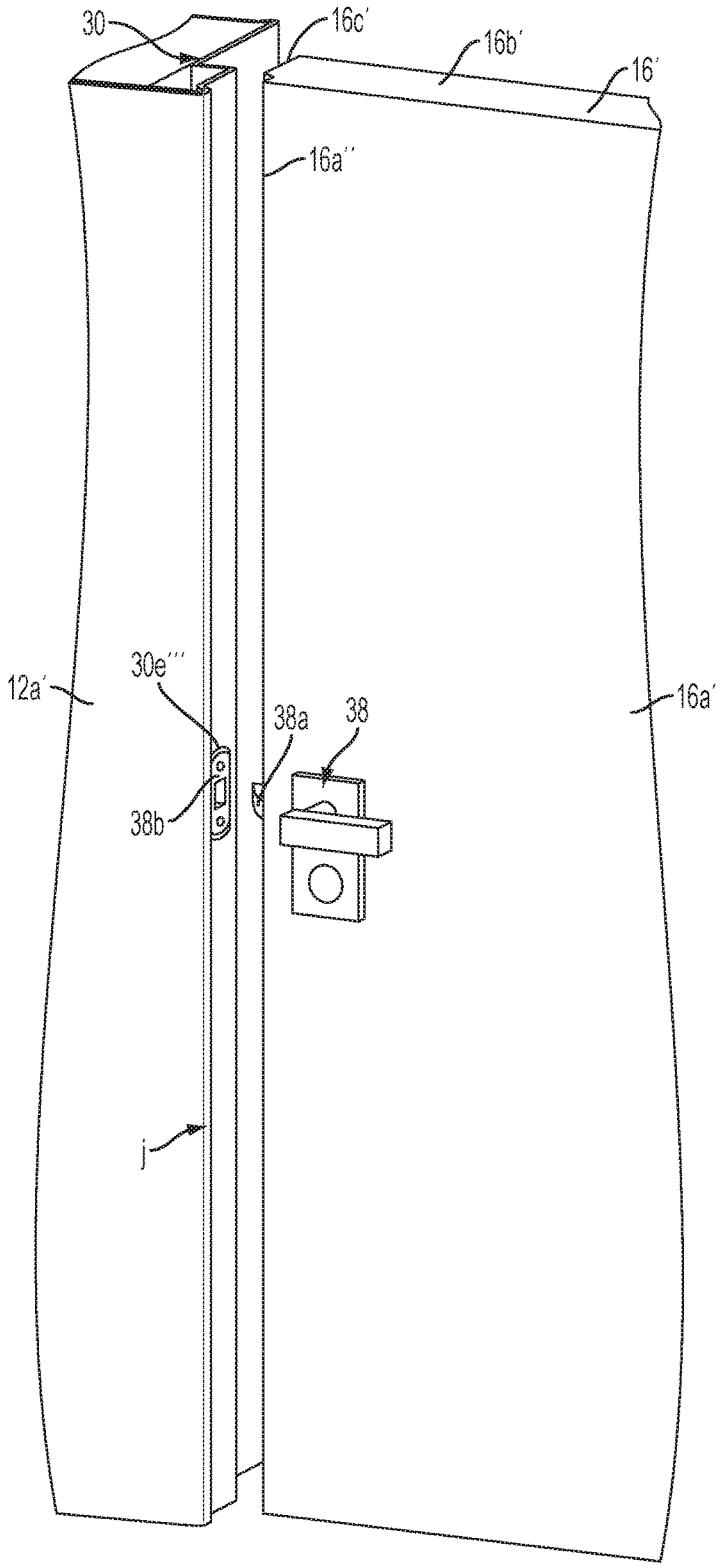
FIG. 6 is a fragmented, perspective view of the wall with inventive door jamb located adjacent the leading edge of the door opposite the hinged edge of the door seen in FIG. 5.
Figure 7:
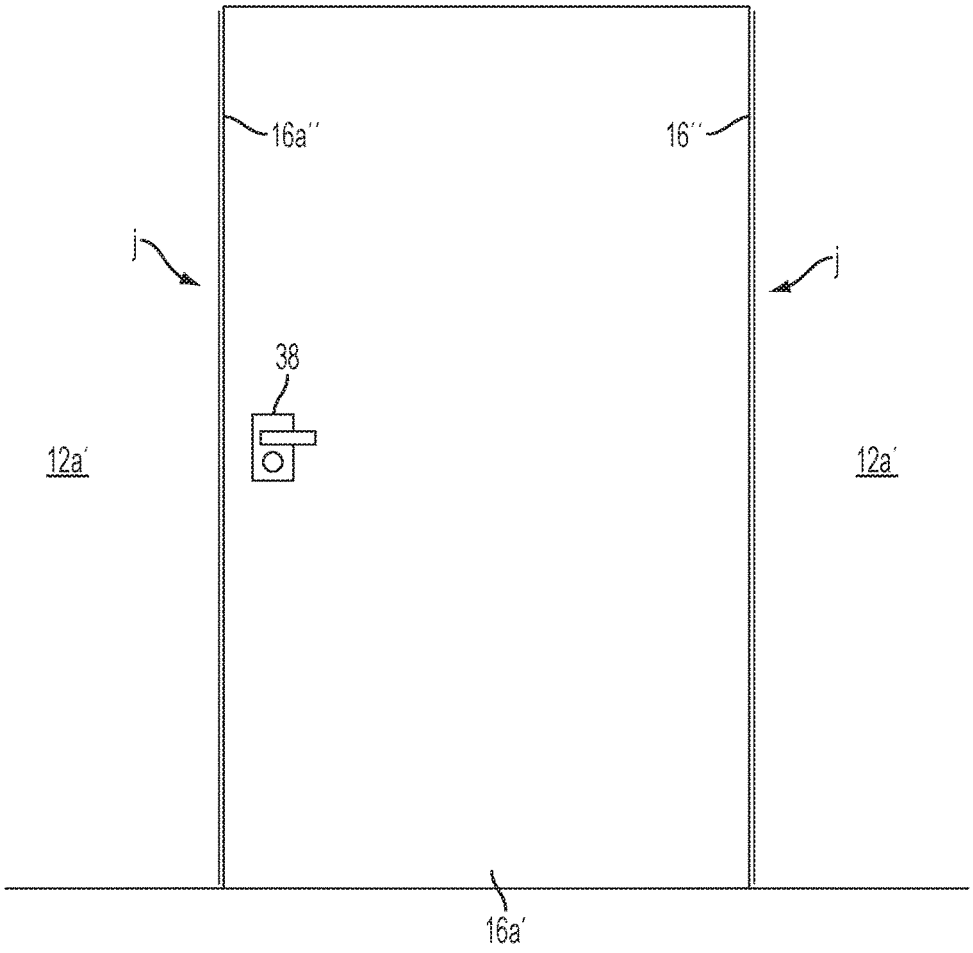
FIG. 7 is a front elevational view showing the adjoining walls and door of FIGS. 3A, 5 and 6 when in the closed position and viewed from the front (direction of swing when the door is opened).

The geometry of jamb 30 and corresponding complimentary geometry of the door leading latch face 16*c*'(FIGS. 3A and 6) and door hinge face 16*d*' (FIG. 5) allow for the flush finish of the in-swing door front surface 16*a*' with wall 12*a*' (FIG. 7). More particularly, the jamb wall segments extending between jamb first and second side walls 30*a*, 30*b* are sized and angled in a particular relationship with each other such that the in-swing (front) door surface 16*a*' will lie flush with the surrounding wall surface 12*a*'.

Figure 3B:
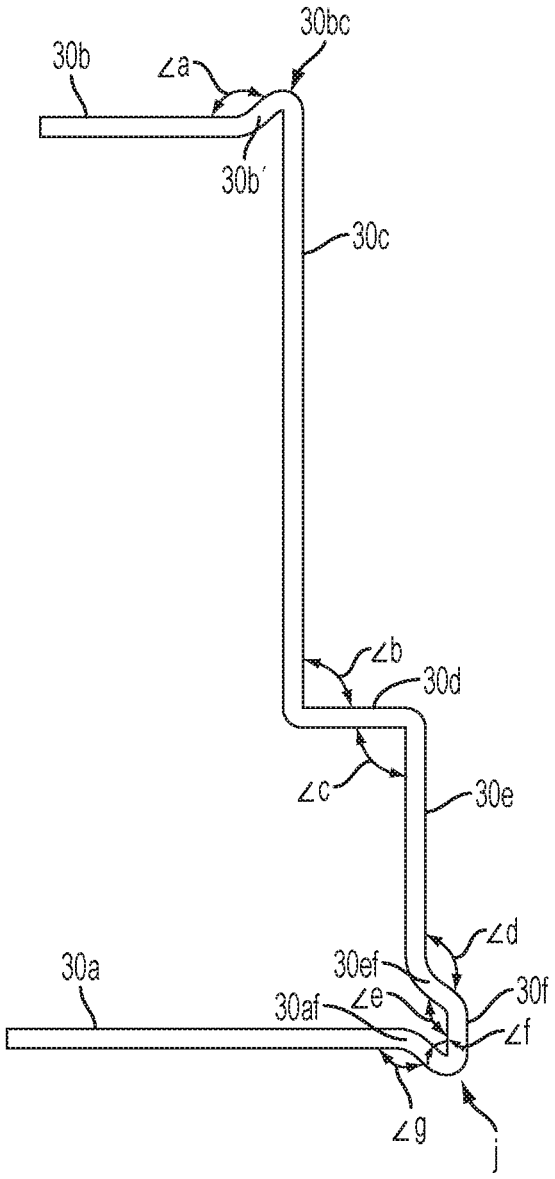
FIG. 3B is a cross-sectional view of the door jamb with angle labels.
Figure 3C:
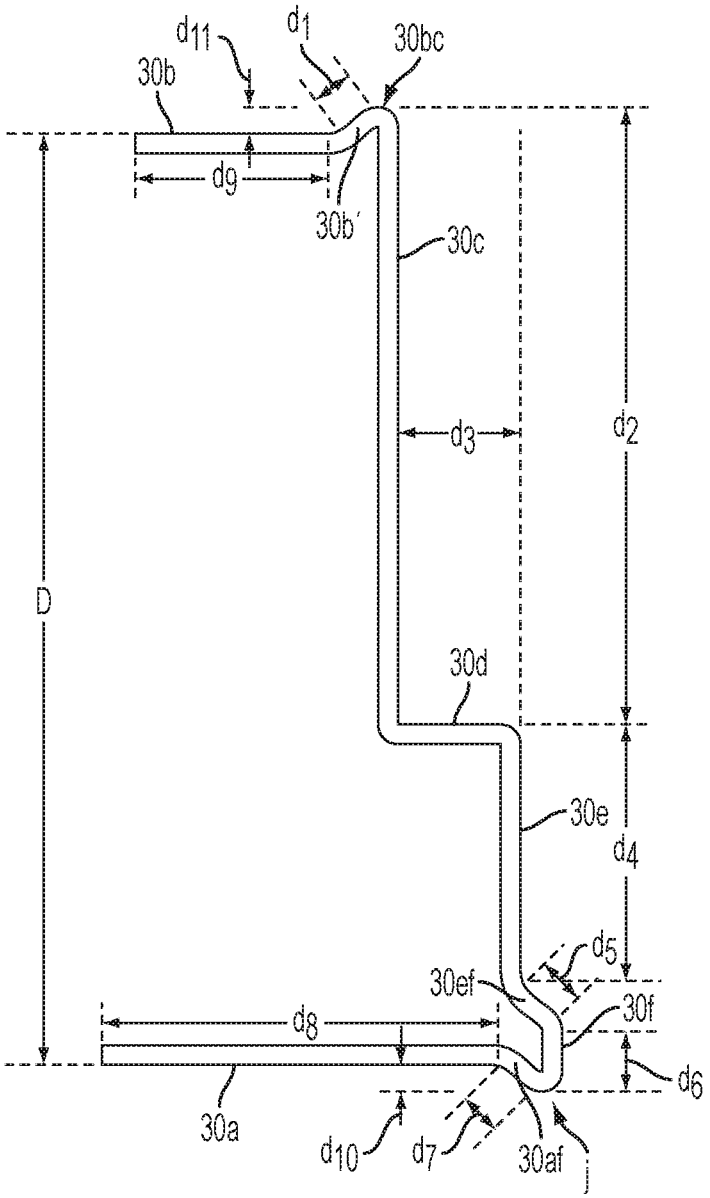
FIG. 3C is the view of FIG. 3B, simplified, with dimension labels.
Figure 4:
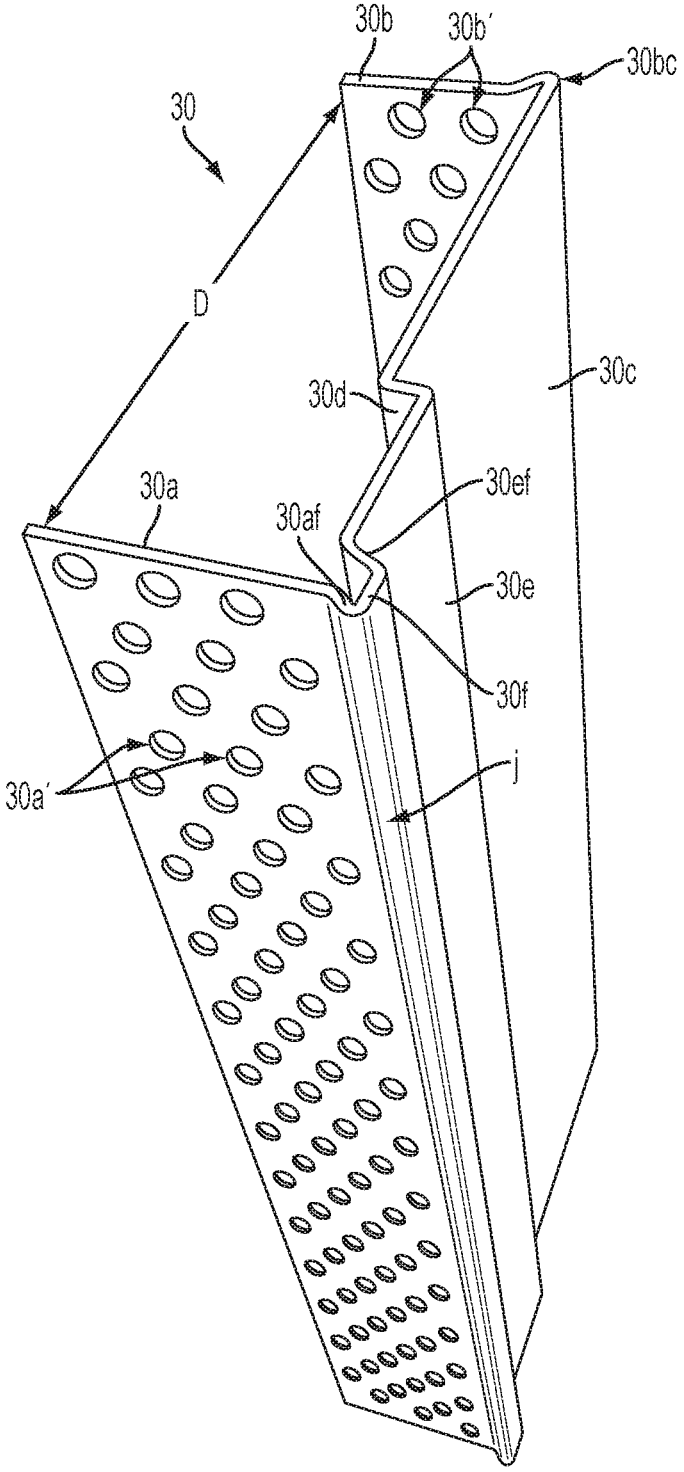
FIG. 4 is a perspective view of the door jamb seen in FIGS. 3A-C and 5-7.

As seen best in the embodiment of FIGS. 3A-C, jamb first side wall segment 30*a* extends to a third wall segment 30*af* which extends to protrusion/juncture "j" which extends to fourth wall segment 30*f*; fourth wall segment 30*f* extends to fifth wall segment 30*ef*; fifth wall segment 30*ef* extends to sixth wall segment 30*e*; sixth wall segment 30*e* extends to seventh wall segment 30*d*; seventh wall segment 30*d* extends to eighth wall segment 30*c* which itself extends substantially parallel to and spaced from wall segment 30*e*; and eighth wall segment 30*c* extends to ninth wall segment 30*b*' which extends back toward and joins second side wall 30*b*.

The protrusion or juncture formed at the intersection of wall segments 30*f* and 30*af* is indicated by arrow "j" and is offset by a distance $d_{10}$ from the plane in which side wall segment 30*a* lies. It is within this space $d_{10}$ that finishing materials such as plaster 18*a*' (FIG. 3A) may be applied over wall segment 30*a* (and extending into substantially all of the holes 30*a*', 30*b*' (see FIG. 4) and blended with the remaining wall surface 40*a* such that the finishing surface 18*a*' creates an aesthetically pleasing, uninterrupted wall surface up to juncture "j". As seen in FIG. 3A, the plaster 18*a*' when applied may be gradually tapered down to the dry wall as the plaster extends in a direction opposite to the door opening.

The same process may be performed adjacent second side wall 30*b* where the distance between the outwardly facing surface of side wall 30*b* and protrusion 30*bc* forms a space $d_{11}$ where finishing material such as plaster 18*b*' may be applied over wall segment 30*b* and blended with the remaining wall surface 40*b* such that the finishing surface 18*b*' creates an aesthetically pleasing, uninterrupted wall surface up the protrusion 30*bc*.

As explained above, the individual wall segments are angled with respect to each other in a manner allowing the jamb 30 to create the desired flush in-swing door. In the embodiment of FIG. 3B, wall segment 30*b*' extends at an obtuse angle "a" relative to wall segment 30*b* and forms a protrusion indicated at 30*bc*. Wall segment 30*c* extends approximately perpendicular to wall segment 30*b*. In one embodiment, wall segment 30*c* extends at an angle of about 88 degrees relative to wall segment 30*b*. Wall segment 30*d* extends from wall segment 30*c* at a substantially right angle "b". Wall segment 30*e* extends from wall segment 30*d* at a substantially right angle "c". Wall segment 30*ef* extends from wall segment 30*e* at an obtuse angle "d", and wall segment 30*f* extends from wall segment 30*ef* at an obtuse angle "e".

The juncture of wall segments 30*f* and 30*af* forms a protrusion or juncture "j" having an acute inner angle "f". Wall segment 30*a* extends from wall segment 30*af* at an obtuse angle "g". In one embodiment, wall segment 30*a* extends at an angle of about 88 degrees relative to wall segment 30*e*. Of course the particular angles may vary to fit the jamb 30 to the particular door and door opening dimensions.

Referring to FIG. 3C, wall segment 30*b* extends from its free end to wall segment 30*b*' by a distance $d_9$; wall segment 30*b*' extends at a distance $d_1$; wall segment 30*c* extends at a distance $d_2$; wall segment 30*d* extends a distance $d_3$; wall segment 30*e* extends between wall segment 30*d* and 30*ef* a distance $d_4$; wall segment 30*ef* extends between wall segments 30*e* and 30*f* by a distance $d_5$; wall segment 30*f* extends between wall segments 30*ef* and 30*af* by a distance $d_6$; wall segment 30*af* extends between wall segments 30*a* and 30*f* be a distance $d_7$; and wall segment 30*a* extends between its free end and wall segment 30*af* by a distance $d_8$.

In one embodiment, $d_1$ is about 0.25", $d_2$ is about 3.5", $d_3$ is about 0.25", $d_4$ is about 1.25", $d_5$ is about 0.25", $d_6$ is about 0.30", $d_7$ is about 0.25", $d_8$ is about 2" and $d_9$ is about 1.25". Of course these particular distances may vary to fit the jamb to the particular door and door opening dimensions.

As seen in FIG. 3A and as explained above, plaster 18*a*' is applied over dry wall 40*a* and jamb side wall 30*a* up to the point of protrusion/junction "j". Likewise, on the other side, plaster 18*b*' is applied over dry wall 40*b* and jamb side wall 30*b* up to the point of protrusion 30*bc*.

Figure 5:
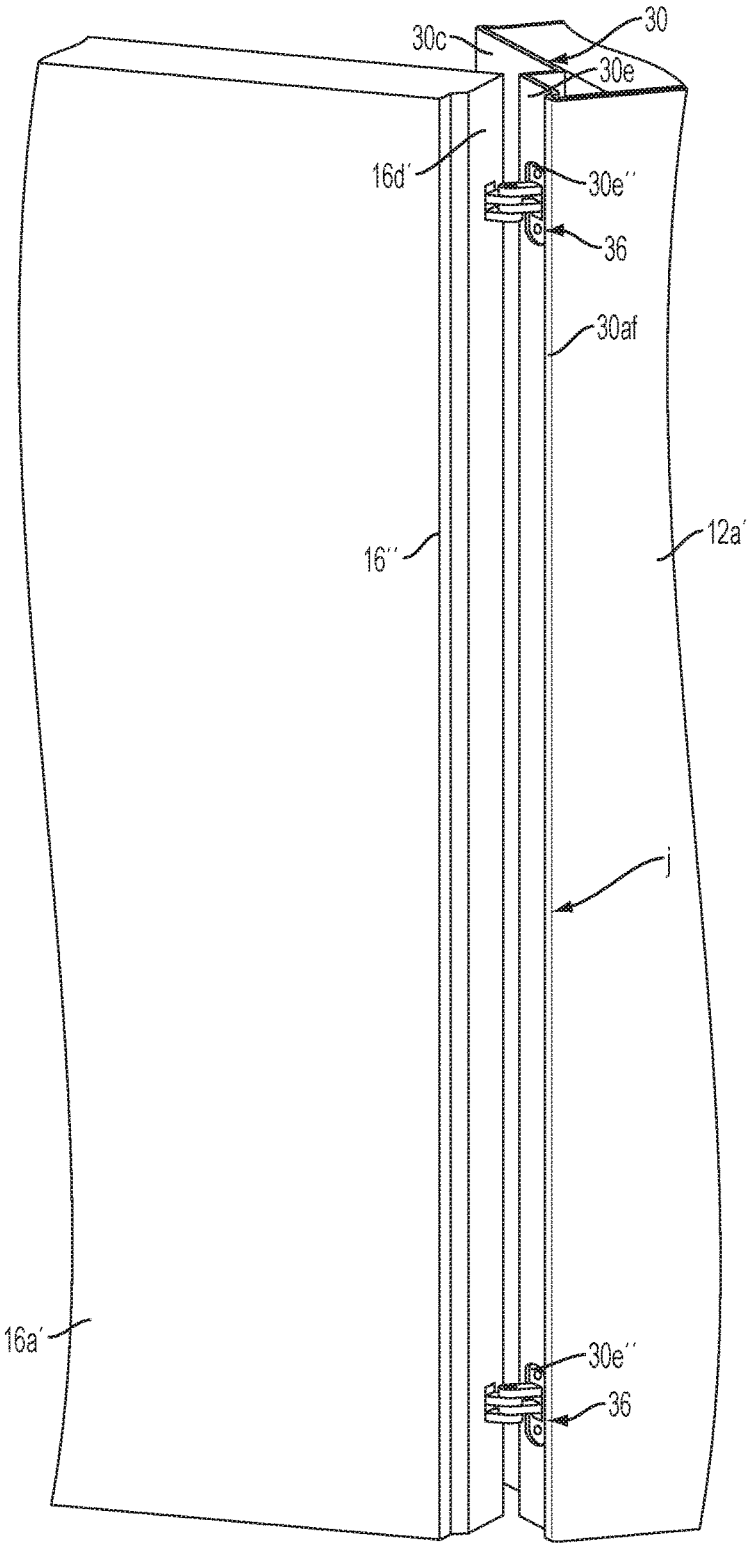
FIG. 5 is a fragmented, perspective view of the wall and hinged edge of the door mounted to the inventive door jamb with the door shown slightly opened.

The same door jamb 30 (with differently positioned openings for the door hinge hardware as will be discussed below) is used at the hinge edge of the door 16*d*' (FIG. 5).

The door latch face 16*c*' and door hinge face 16*d*' each include an angled profile which is complimentary to and thus closely matches the angled profile of fourth, fifth and sixth jamb wall segments 30*f*, 30*ef* and 30*e*, respectively. When in the closed position, the door latch face front edge 16*a*" of door 16' will lie in a mating fashion closely adjacent to jamb protrusion "j" (see FIGS. 3A, 6 (door is slightly ajar in FIGS. 6) and 7), and the hinge face front edge 16" of door 16' will lie in a mating fashion closely adjacent jamb protrusion "j" (see FIG. 5 (door is slightly ajar in FIGS. 5) and 7).

Thus, as seen best in FIGS. 3A and 7, when in the closed position, as looking at the front surface 16*a*' of the in-swing door (toward the direction of in-swing), the door front surface 16*a*' will lie flush with the surrounding wall with the only part of each jamb 30 (one along the latch side and one along the hinge side of the door) showing being the extremely narrow width juncture segment "j".

As mentioned above, openings may be formed in jamb 30 to accommodate hardware such as a door latch and hinges. In FIG. 5, openings 30*e*" are formed in jamb wall segment 30*e* to accommodate top and bottom concealed-type hinges 36. As such, when the door is closed, concealed hinges 36 are not visible. It is understood other types of hinges which may be visible may be used as desired. In FIG. 6, opening 30*e*'" is formed in jamb wall segment 30*e* to accommodate latch receiver 38*b* in which door latch 38*a* locates when the door is closed. Latch 38*a* is mechanically connected to door handle 38 and when the door is closed, latch receiver 38*b* and latch 38*a* are also visible.

While the invention has been shown and described with reference to certain preferred embodiments thereof, it will be understood by those skilled in the art that various changes in form and details may be made therein without departing from the spirit and scope of the invention as described.

What is claimed is:

1. A door jamb for interfacing with an in-swing door installed at a door opening defined at least in part by said doorjamb, the in-swing door having a front surface, a latch face and a hinge face, said door jamb comprising:

a) first and second, spaced side wall segments adapted to be attached to opposite sides of a wall stud at the door opening;

b) third, fourth, fifth and sixth contiguous wall segments located between said first side wall and said second side wall segments, said third and fourth wall segments forming a protrusion at their juncture, said protrusion and said first side wall segment being offset from each other and thereby defining a space ($d_{10}$) adapted to be filled with a wall finishing material;

c) said fourth wall segment extending parallel to and spaced from said sixth wall segment such that said fourth, fifth and sixth wall segments together form a stepped surface against which a complimentary shaped door latch face surface of the in-swing door is positioned when in the closed position and wherein the door front surface lies closely adjacent said protrusion to create a flush finish of the door front surface with the wall surrounding the door opening along said door jamb first side wall segment with said jamb protrusion lying closely adjacent said latch face front edge, the interface between said door jamb and in-swing door allowing the in-swing door to be pivoted from the closed position to open in a direction directed against the door front surface and toward the plane in which said second wall segment lies.

2. The door jamb of claim 1, and further comprising a second door jamb having the same configuration as said door jamb of claim 1, said second door jamb for locating adjacent the hinge face of the in-swing door, and wherein the hinge face is complimentary shaped to said fourth, fifth and sixth wall segments of said second door jamb and wherein the hinge face has a front edge extending adjacent the door front surface, said hinge face front edge locating closely adjacent said second door jamb protrusion to create a flush finish of the door front surface with the wall surrounding the door opening when the in-swing door is closed.

3. The door jamb of claim 1, and further comprising seventh, eighth and ninth wall segments extending contiguously between said second side wall segment and said sixth wall segment, said eighth wall segment extending spaced and parallel to said sixth wall segment, the juncture of said eighth and ninth segments forming a second protrusion, said second protrusion and said second side wall being offset from each other and thereby defining a space ($d_{11}$) adapted to be filled with a wall finishing material.

4. The door jamb of claim 1 wherein said first and second side walls each include a plurality of openings through which fasteners and wall finishing material may extend.

* * * * *